US008500954B2

(12) United States Patent
Lehto et al.

(10) Patent No.: US 8,500,954 B2
(45) Date of Patent: Aug. 6, 2013

(54) METHOD AND APPARATUS FOR PROCESSING BLACK LIQUOR OF PULP MILL

(75) Inventors: Jani Lehto, Tampere (FI); Kari Kuukkanen, Tampere (FI); Erkki Välimäki, Tampere (FI)

(73) Assignee: Metso Power OY, Tampere (FI)

( * ) Notice: Subject to any disclaimer, the term of this patent is extended or adjusted under 35 U.S.C. 154(b) by 292 days.

(21) Appl. No.: 12/896,201

(22) Filed: Oct. 1, 2010

(65) Prior Publication Data

US 2011/0247771 A1 Oct. 13, 2011

(30) Foreign Application Priority Data

Oct. 5, 2009 (FI) ..... 20096018

(51) Int. Cl.
*D21C 11/00* (2006.01)
*D21C 11/12* (2006.01)

(52) U.S. Cl.
USPC ..... 162/29; 162/30.1; 162/31

(58) Field of Classification Search
None
See application file for complete search history.

(56) References Cited

FOREIGN PATENT DOCUMENTS

WO WO 9508022 A1 * 3/1995

* cited by examiner

*Primary Examiner* — Anthony Calandra
(74) *Attorney, Agent, or Firm* — Ladas & Parry LLP

(57) ABSTRACT

The invention relates to a method and apparatus for processing the black liquor of a pulp mill to recover the chemicals and energy therein. In the invention, the black liquor is pyrolyzed in a pyrolysis reactor (6), formed gaseous components are lead for utilization, sand is returned to a fluidized-bed boiler, and solid matter is mixed with water, whereby a soda-water solution is returned to the pulping process and solid carbon to the fluidized-bed boiler (1).

19 Claims, 4 Drawing Sheets

METHOD AND APPARATUS FOR PROCESSING BLACK LIQUOR OF PULP MILL

BACKGROUND OF THE INVENTION

The invention relates to a method for processing the black liquor of a pulp mill to recover the chemicals and energy therein. The invention further relates to an apparatus for processing the black liquor of a pulp mill to recover the chemicals and energy therein.

In a pulp process, wood raw material, such as chips, is processed using heat and chemicals by cooking it in a chemical solution that contains lye among other things. This is called pulping. The aim of the process is to remove fibre-binding lignin. The cooking chemicals used in sulphate cooking are a mixture of sodium hydroxide (NaOH) and sodium sulphide ($Na_2S$). In soda cooking, the cooking chemical is sodium hydroxide (NaOH). In carbonate cooking, the cooking chemical is sodium carbonate ($NaCO_3$). After cooking, the fibre pulp detached from the wood material is separated from the pulping liquor in which the various wood material components, such as lignin and inorganic matter, dissolved during cooking remain. This chemical mixture, that is, black liquor, separated after cooking is then evaporated in an evaporation plant so as to produce a burnable material that contains as little water as possible. This material obtained from the final step of the evaporation plant and conventionally fed into a recovery boiler to be burned may have a dry matter content of up to 85%.

Traditionally, black liquor is burned in a recovery boiler, whereby vapour and electricity is produced for use as energy for the mill and possibly for sale. The inorganic part of black liquor is removed from the recovery boiler as salt in the liquid state; this produces heat, with which water is heated and vaporised to produce energy, and salt in the liquid state, from which cooking chemicals are re-made. This is disclosed in Finnish patents 82494 and 91290, for example.

Black liquor gasification has been tried as a replacement for the recovery boiler, but a commercially competitive solution is yet to be achieved in practice.

WO publication 2004/005610 discloses a solution, wherein black liquor is pyrolyzed and the coke from the pyrolysis is gasified. However, this process is in practice difficult and requires a separate and expensive gasification apparatus.

BRIEF DESCRIPTION OF THE INVENTION

It is an object of this invention to provide a method and apparatus for processing black liquor, with which the recovery boiler can be eliminated from the process, and which is simple and easily implemented using mainly already existing pulp mill equipment.

The method of the invention is characterised by

- feeding black liquor into a pyrolysis reactor having a substantially oxygen-free space,
- feeding into the pyrolysis reactor sand heated in a fluidised-bed boiler, whereby the black liquor is pyrolized and forms gaseous components and solid matter,
- leading the gaseous components formed in the pyrolysis reactor on for utilization,
- separating sand from the solid matter formed in the pyrolysis reactor and returning it to the fluidised-bed boiler,
- adding water to the remaining solid matter, into which the soda in the solid matter is dissolved,

- returning the formed soda-water solution to the pulp process and returning the remaining solid carbon to the fluidised-bed boiler.

The apparatus of the invention is characterised in that it comprises

- a fluidised-bed boiler,
- a pyrolysis reactor into which the black liquor is fed and where the black liquor is pyrolyzed in a substantially oxygen-free space and forms gaseous components and solid matter,
- means for feeding the sand obtained from the fluidised-bed boiler to the pyrolysis reactor,
- means for leading the gaseous components formed in the pyrolysis reactor on for utilization,
- a separator for separating sand from the solid matter formed in the pyrolysis reactor,
- means for returning the separated sand to the fluidised-bed boiler,
- a mixing reactor for mixing the separated solid matter with water so that the soda in the solid matter is dissolved into the water,
- means for returning the soda-water solution to the pulp process and for returning the remaining solid carbon to the fluidised-bed boiler.

An essential idea of the invention is that black liquor is pyrolyzed by feeding the black liquor and sand heated in the fluidised-bed boiler into one and the same pyrolysis reactor, wherein the black liquor is heated to a suitable temperature in a substantially oxygen-free space so that the volatile materials contained in the black liquor transform into gaseous state. A further essential idea of the invention is that gaseous components are separated from the solid matter and fed for utilization in the production of electricity, for instance; sand is separated from the solid matter and led back to the fluidised-bed boiler; and solid matter is mixed with water, thus producing a soda-water solution and, as solid material, carbon that is led to the fluidised-bed boiler, for instance, for further use. According to an embodiment of the invention, an inert gas or gas mixture is also fed into the pyrolysis reactor. According to yet another embodiment of the invention, the gaseous components formed in the pyrolysis reactor are led to further processing, such as purification and/or condensation. According to yet another embodiment of the invention, the sand is fed into the pyrolysis reactor so hot that it heats the black liquor to a temperature required by pyrolysis, whereby no additional heating is required in the pyrolysis reactor.

The method of the invention provides the advantage that just one chemical cycle achieves the recovery of energy and chemicals. In addition, the pyrolysis oil separated from the gaseous components by condensation can be used as a substitute for a fossil fuel or, if necessary, it may be further refined to a traffic fuel. Another advantage is that when the pyrolysis is fast, the formation of gases is maximized. Also, because the pyrolysis temperature is low, the corrosion and contamination problems of conventional recovery boilers are avoided.

BRIEF DESCRIPTION OF FIGURES

The invention will be described in greater detail in the attached drawings, in which.

DETAILED DESCRIPTION OF THE INVENTION

Figure 1:
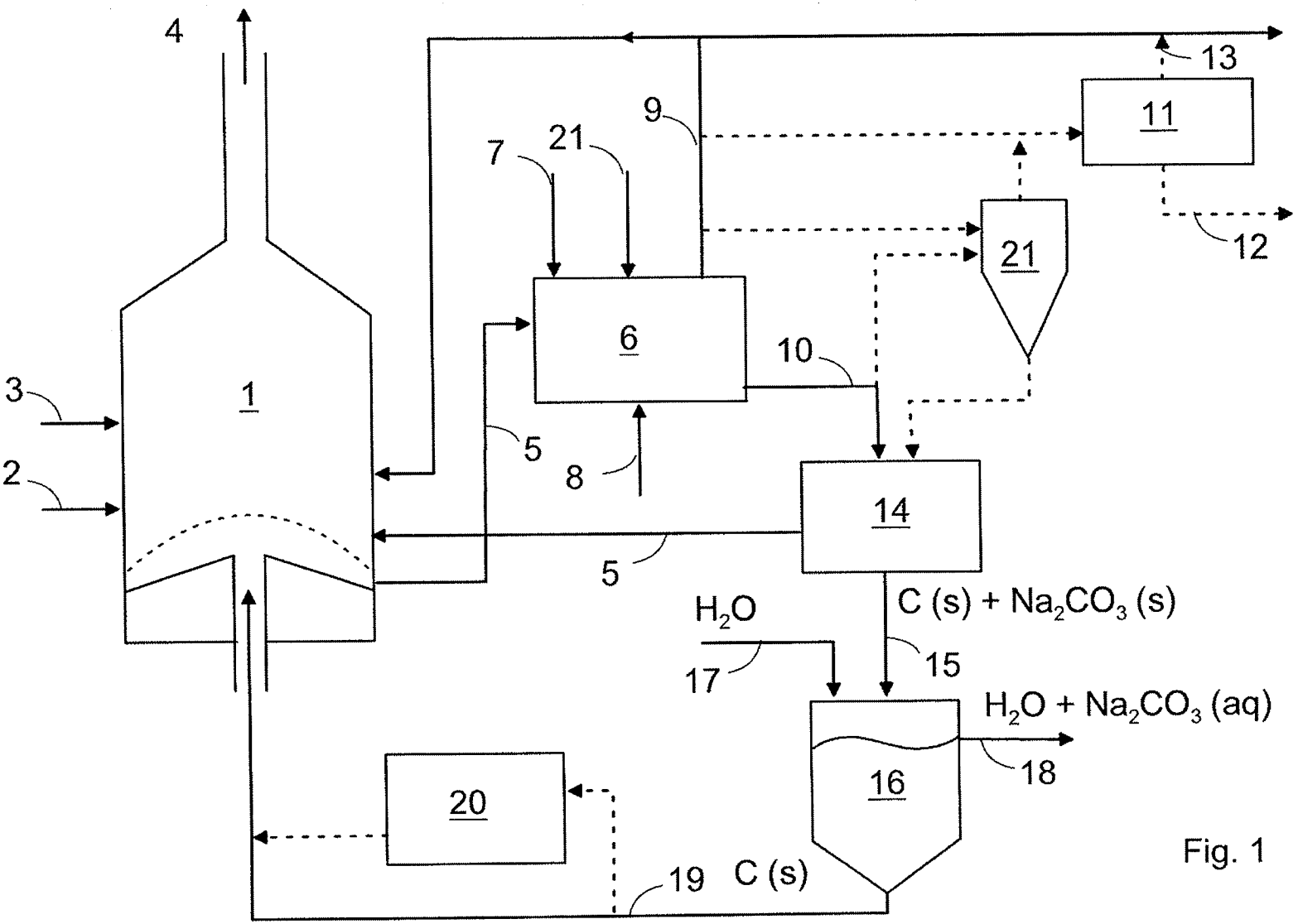
FIG. 1 is a schematic view of an apparatus for applying the method of the invention.

FIG. 1 is a schematic view of an apparatus suitable for applying the method of the invention. It has a fluidised-bed boiler 1 in which a suitable fuel 2, most preferably a fuel formed in a pulp mill, is burned. It is also possible to feed into the fluidised-bed boiler a known solid, liquid or gaseous support fuel 3, such as oil, gas, or some other suitable fuel. From the fluidised-bed boiler, the formed flue gases 4 are led in a manner known per se to purification and possibly heat recovery.

From the fluidised-bed boiler, the heated sand 5 having a typical temperature of 200° C. to 900° C. is led to a pyrolysis reactor 6, into which black liquor 7 and a fluidising gas 8 are also fed. The pyrolysis reactor 6 may be any suitable reactor, such as a fluidised-bed furnace or the like.

The fluidising gas 8 is an inert gas or gas mixture. For this, it is possible to use purely inert gases, but it is considerably more advantageous to use for instance any below-described uncondensed gases or gases that contain reacted gases or gas mixtures, such as carbon monoxide, carbon dioxide, nitrogen, nitrogen oxides or water vapour. Further, even flue gases purified from solid matter, such as the flue gases from the fluidised-bed boiler, may be used as the fluidising gas.

The temperature in the pyrolysis reactor 6 is approximately 200° C. to 900° C., preferably 400° C. to 700° C. When hot sand 5 having a temperature of 200° C. to 900° C. is fed therein, it heats the black liquor. Gaseous components 9 and solid matter 10 that mainly contains soda and solid carbon are then formed in the reactor from the material in the black liquor.

The gaseous components 9 are led for further processing or for use as such in their gaseous form in the preparation of traffic fuels or as support fuels in the fluidised-bed boiler 1. Alternatively, the gases may be led to a condenser 11. In the condenser 11, condensed gases form oil 12 that is led for use as fuel in the production of electricity, or it may be further refined for vehicle fuel, for example. This oil may also be used in the fluidised-bed boiler 1 as support fuel. The uncondensed gases 13 are, in turn, led on to the production of electricity or for utilisation in other ways, and at least part of them may be led back to the fluidised-bed boiler 1 for support fuel or fluidising gas 8.

The mixture of solid matter and sand is led to a separator 14, where the sand 5 is separated from the rest of the solid matter and returned to the fluidised-bed boiler 1. The remaining solid matter 15 is fed into a mixing reactor 16, into which water 17 is also added. The solid-state (s) soda $Na_2CO_3$ (s) in the solid matter 16 then dissolves into the water and can be led back to the pulp process as a soda-water solution 18 [$H_2O$+ $Na_2CO_3$ (aq)]. The remaining solid matter 19 is mainly solid carbon that can be returned to the fluidised-bed boiler as such or after having been dried in a drier 20.

The gaseous components and solid matter may also be led to a separate gas separator 21, which may be a conventional cyclone separator, for instance. In the gas separator 21, the solid matter and sand formed in the pyrolysis reactor 6 are separated from the gaseous components that are led on for utilization, and the solid matter and sand are led to the separator 14 for separating them from each other. If necessary, the pyrolysis reactor 6 may also be heated by using a separate heat source 22 so that no oxygen-containing material is fed into the pyrolysis reactor. Most preferably, indirect heating is used, wherein the heat of a heat source is used to heat the pyrolysis reactor from the outside.

Figure 2:
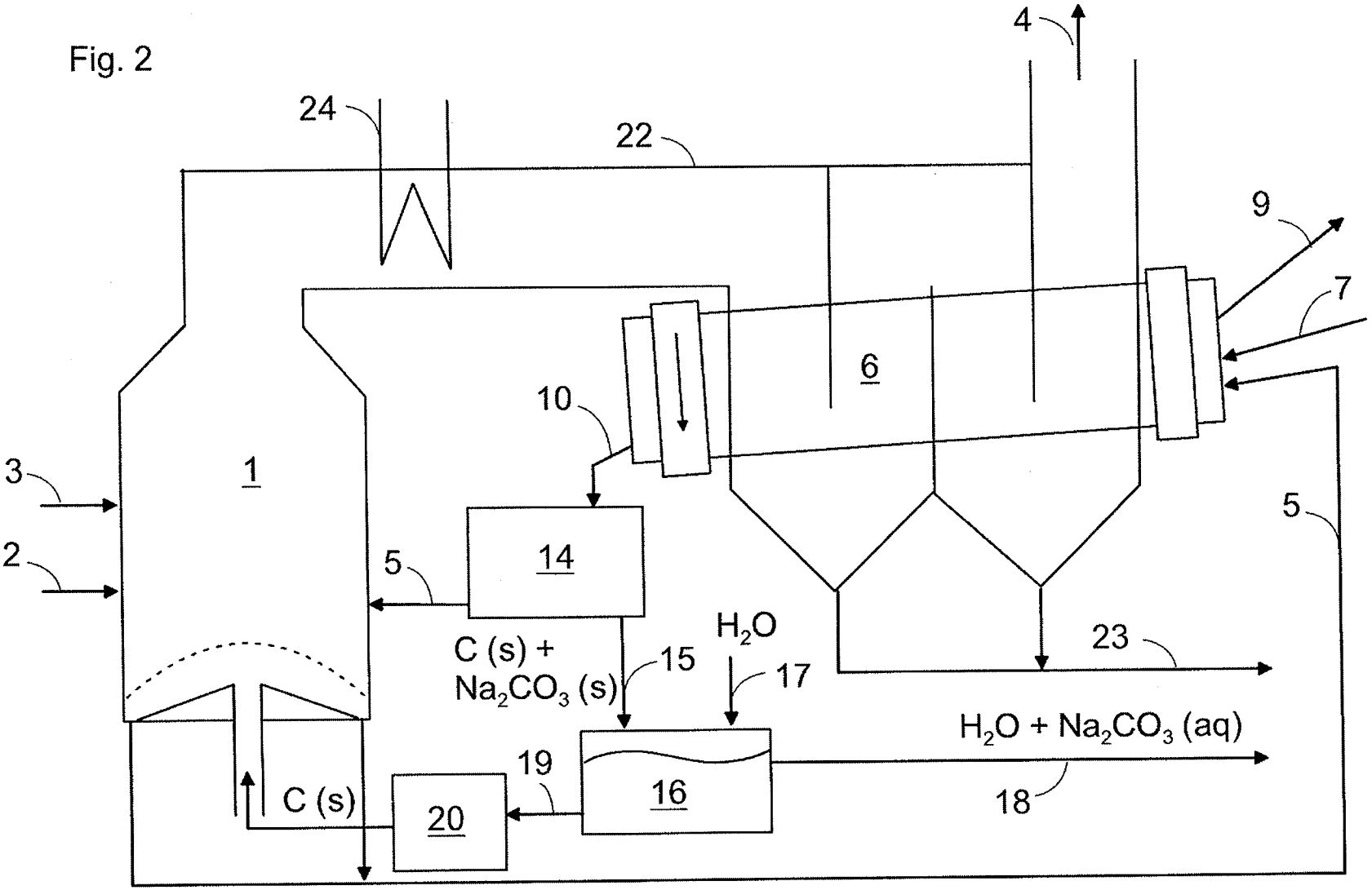
FIG. 2 is a schematic view of a second apparatus for applying the method of the invention.

FIG. 2 is a schematic view of a second apparatus suitable for applying the method of the invention. The same numbers as used in FIG. 1 are used for corresponding components therein and they are not separately explained unless necessary for the understanding of the matter. The solution shown in FIG. 2 differs from the solution shown in FIG. 1 in that the pyrolysis reactor is a rotating furnace that is heated from the outside.

In this case, the pyrolysis reactor 6 is a mainly horizontal, pipe-like furnace that may also rotate around its longitudinal axis. Black liquor 7 and sand 5 are preferably fed into the top end, that is, feed end, of the slightly obliquely positioned furnace and, correspondingly, the solid material 10 is removed from the lower end, that is, discharge end, of the pipe-like furnace into the separator 14. Inside the furnace, there may also be in the longitudinal direction thereof a mixer or feed screw that moves the solid matter through the furnace at a suitable rate. The gaseous components 9 formed in the pyrolysis reactor 6 are removed from the top end of the pipe-like furnace and led on for utilization or processing, as shown in FIG. 1. In this embodiment, a separate separator is not needed for separating the solid matter and gases from each other, and the furnace serving as the pyrolysis reactor 6 also serves as a means for their separation.

The flue gases 4 from the fluidised-bed boiler 1 are led over a separate channel 22 to heat the pyrolysis reactor 6. Around the pipe-like furnace, a preferably heat-insulated channel system or space is built, through which the flue gases from the fluidised-bed boiler 1 flow so that the flue gases arrive at the discharge end of the pyrolysis reactor 6, that is, the pipe-like furnace, and then flow on toward the feed end of the furnace and from there, the flue gases 4 are removed for processing as required. This way, counter-flow heating takes place in the pyrolysis reactor, whereby the black liquor being pyrolyzed heats up continuously as it advances through the furnace toward the discharge end. At least one discharge channel 23 for discharging the solid matter, such as ash, separated from the flue gases is preferably formed in the flue gas channel 22 at the pyrolysis reactor or some other suitable place.

Instead of or in addition to heating with the flue gases of the fluidised-bed boiler, the pyrolysis reactor can also be heated by burners using liquid or gaseous fuel by feeding their hot flue gases to heat the pyrolysis reactor.

When using separate external heating in the pyrolysis reactor, the temperature of the sand fed therein may be lower, because the sand does not need to heat up the black liquor to the pyrolysis temperature, as this is done with the additional heating. Thus, the temperature of the fed sand may be only 200° C. or more.

If, in view of the operation of the pyrolysis reactor 6, the temperature tries to rise too high or the exiting flue gases are too hot, the flue gases may be cooled before they are fed to heat up the pyrolysis reactor 6 by using cooling solutions known per se, such as coolers or heat delivery surfaces 24, in which the heat of the flue gases is recovered and utilized somewhere else in the process.

Instead of flue gas heating, it is also possible to use some other heating method, with which the temperature in the pyrolysis reactor 6 becomes suitable for pyrolysis, preferably 400° C. to 700° C.

When using a horizontal furnace as the pyrolysis reactor 6, it does not require separate fluidising gas.

Figure 3:
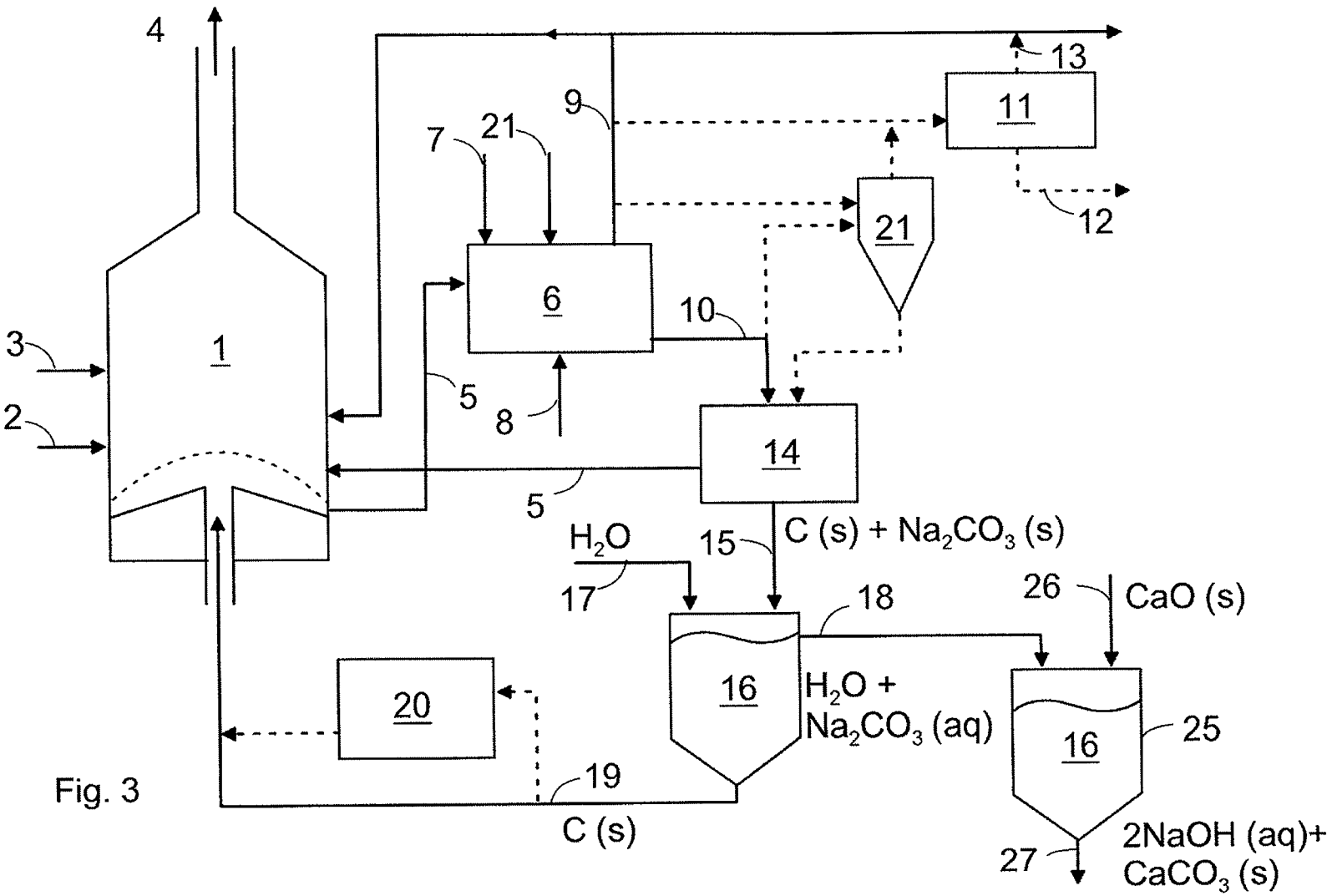
FIG. 3 is a schematic view of a third apparatus for applying the method of the invention.
Figure 4:
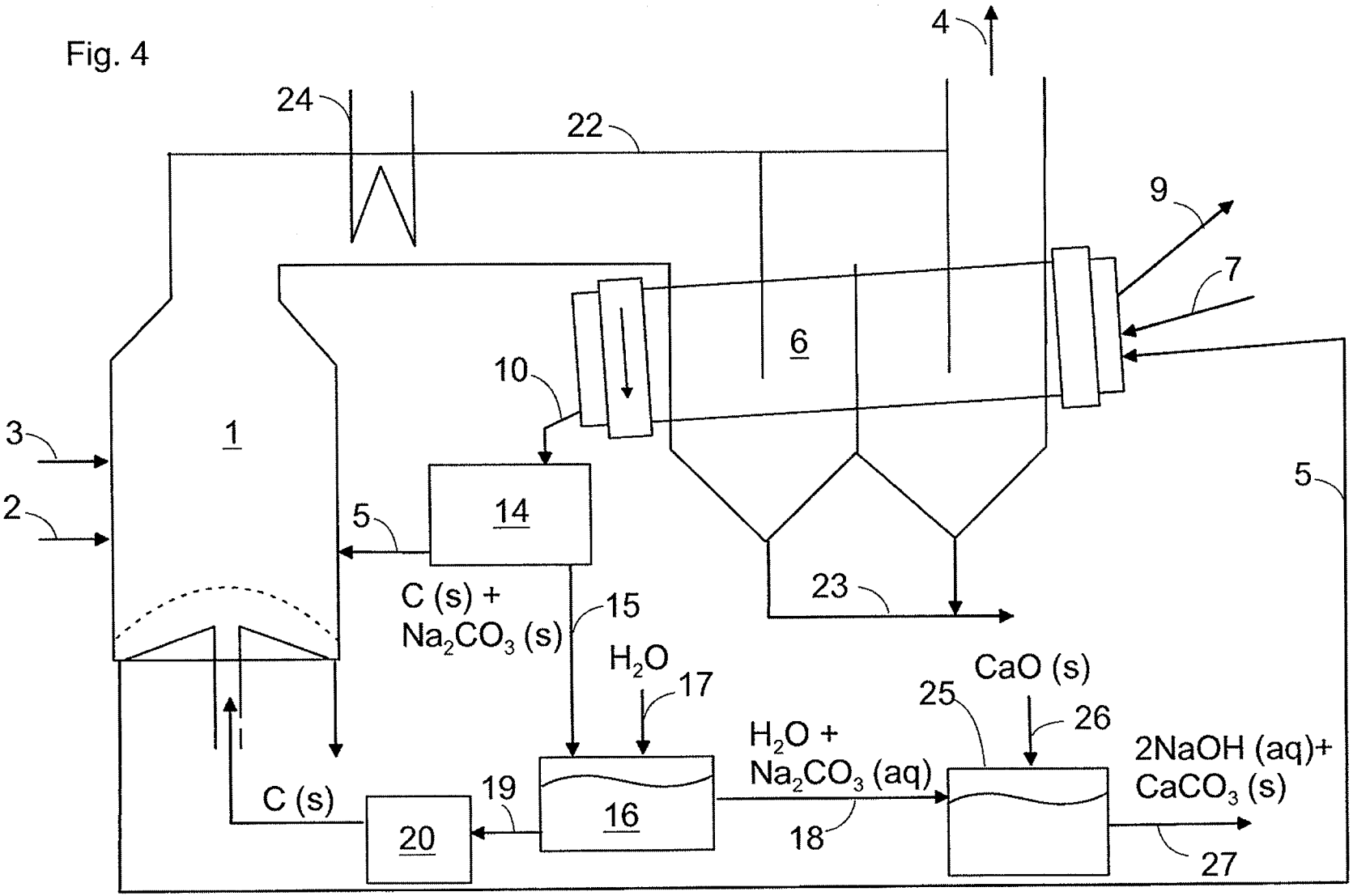
FIG. 4 is a schematic view of a fourth apparatus for applying the method of the invention.

FIGS. 3 and 4 show yet other embodiments of the invention.

FIG. 3 shows a solution corresponding to that of FIG. 1 and FIG. 4 shows a solution corresponding to that of FIG. 2 except that they also have a separate causticizing vessel 25, into which the soda-water solution 18 [$H_2O$+$Na_2CO_3$ (aq)] is fed. In addition, calcium oxide 26 (CaO) is fed as solid matter (s) into the causticizing vessel 25, whereby sodium hydroxyide (NaOH) and calcium carbonate ($CaCO_3$) are obtained as the reaction product. The mixture 27 formed by these is led to a separator, which is known per se and not shown herein and from which sodium hydroxide (NaOH) is returned to the process and calcium carbonate ($CaCO_3$) is led to be burned in a manner known per se, after which the formed calcium oxide (CaO) may again be fed into the causticizing vessel.

The method of the invention thus does not require a conventional recovery boiler and the recovery of black liquor chemicals can be done mainly by means of the pyrolysis reactor, the size and investment costs of which are a fraction of the costs of a recovery boiler. Similarly, the operating costs of the pyrolysis reactor are quite low in comparison with the recovery boiler. Since the gas formed in the pyrolysis reactor can also be utilized or further refined for use as fuel for gas turbines or diesel power plants, the electricity and vapour needed in the process can be produced in a considerably more efficient manner than by using the known recovery boiler solutions. Also, when applying the solution of the invention, the expensive gasifier solutions, which are at least according to current experience quite difficult to apply, can be avoided.

The fluidised-bed boiler may be any known fluidised-bed boiler in which sand can be heated and from which sand can be recycled into the pyrolysis reactor. The pyrolysis reactor may be any suitable one, but the use of horizontal rotating cylindrical furnaces is preferable, because their operation and behaviour is well known and controllable. The mixing reactor can, in turn, be any suitable mixing reactor, to which the solid matter from the separator and water can be fed and from which the solution and solid matter can be suitably removed. It is also possible to use after the mixing reactor a separate separator with which the soda-water solution is separated from the solid matter. If necessary, the solid matter, which is mainly carbon, can be dried before it is fed into the fluidised-bed boiler.

The invention is described above in the specification and drawings by way of example only and it is in no way limited thereto, and the scope of protection is defined in accordance with the attached claims. Thus, the individual features of the different working examples may also be combined and, in a required manner, applied to other embodiments.

The invention claimed is:

1. A method for processing black liquor of a pulp mill to recover the chemicals and energy therein, the method comprising feeding the black liquor into a pyrolysis reactor having a substantially oxygen-free space, feeding into the pyrolysis reactor sand heated in a fluidised-bed boiler, whereby the black liquor is pyrolized and forms gaseous components and solid matter, said solid matter comprising the sand, solid carbon and soda leading the gaseous components formed in the pyrolysis reactor on for utilization, separating the sand from the solid matter formed in the pyrolysis reactor thereby forming a remaining solid matter comprising soda and the solid carbon and returning the sand to the fluidised-bed boiler, adding water to the remaining solid matter, into which the soda in the solid matter is dissolved forming a soda-water, separating and returning the solid carbon in the soda-water to the fluidised-bed boiler and then returning the soda-water solution to the pulp process.

2. A method as claimed in claim 1, wherein the gaseous components and solid matter formed in the pyrolysis reactor are led to a separator to separate them from each other.

3. A method as claimed in claim 1, wherein inert gas or inert gas mixture is supplied into the pyrolysis reactor, to which gas or gas mixture the black liquor is mixed.

4. A method as claimed in claim 3, wherein the inert gas or inert gas mixture led to the pyrolysis reactor is at least partly formed of the gases obtained from the pyrolysis reactor, which remain uncondensed after condensation.

5. A method as claimed in claim 3, wherein the inert gas or inert gas mixture led to the pyrolysis reactor is at least partly formed of carbon dioxide or carbon monoxide.

6. A method as claimed in claim 3, characterised in that the inert gas or inert gas mixture led to the pyrolysis reactor is at least partly formed of nitrogen or nitrogen oxides.

7. A method as claimed in claim 3, wherein the inert gas or inert gas mixture led to the pyrolysis reactor is at least partly formed of flue gases.

8. A method as claimed in claim 1, wherein the temperature in the pyrolysis reactor is 200° C. to 900° C.

9. A method as claimed in claim 1, wherein sand is fed into the pyrolysis reactor at a temperature of 200° C. to 900° C.

10. A method as claimed in claim 1, wherein the pyrolysis reactor is also heated with a heat source separate from sand heated in a fluidised-bed boiler.

11. A method as claimed in claim 10, wherein the pyrolysis reactor is heated by external heating.

12. A method as claimed in claim 11, wherein the pyrolysis reactor is heated by heating it from the outside with flue gases from the fluidised-bed boiler.

13. A method as claimed in claim 1, wherein a substantially horizontal cylindrical furnace is used as the pyrolysis reactor.

14. A method as claimed in claim 13, wherein the cylindrical furnace is rotated during the pyrolysis.

15. A method as claimed in claim 1, wherein a cyclone is used as the separator.

16. A method as claimed in claim 13, wherein the horizontal cylindrical furnace serving as the pyrolysis reactor is used as the separator.

17. A method as claimed in claim 1, wherein the gaseous components separated in the separator are condensed in a condenser, whereby oil is produced, and the uncondensed gases are led for reuse in other processes requiring fuel.

18. A method as claimed in claim 8, wherein the temperature in the pyrolysis reactor is 400° C. to 700° C.

19. A method as claimed in claim 9, wherein sand is fed into the pyrolysis reactor at a temperature of 400° C. to 700° C.

* * * * *